United States Patent [19]

Siegmann

[11] Patent Number: 4,493,156

[45] Date of Patent: Jan. 15, 1985

[54] PRODUCE SPIN DRYER

[76] Inventor: Robert L. Siegmann, 1270 North Grove, Anaheim, Calif. 92806

[21] Appl. No.: 508,822

[22] Filed: Jun. 29, 1983

[51] Int. Cl.[3] ..... F26B 5/08

[52] U.S. Cl. ..... 34/8; 34/56; 34/58

[58] Field of Search ..... 34/8, 58, 184, 56, 236

[56] References Cited

U.S. PATENT DOCUMENTS

| | | | |
|---|---|---|---|
| 3,103,420 | 9/1963 | Epstein | 34/58 |
| 3,413,729 | 12/1963 | Wagner | 34/58 |
| 3,570,135 | 3/1971 | Rousselet | 34/58 |
| 4,103,432 | 8/1978 | Dieterich et al. | 34/58 |
| 4,461,096 | 7/1984 | Suzuki | 34/56 |
| 4,467,530 | 8/1984 | Fesmire et al. | 34/8 |

*Primary Examiner*—Larry I. Schwartz
*Assistant Examiner*—David W. Westphal

[57] ABSTRACT

The drying container has foraminous side walls and an open bottom which is received onto a vertically positionable, upwardly facing lower wall having a sloping surface. A pair of semi-cylindrical shielding walls encircle the drying basket and are spaced therefrom, the inner surface of which includes a trough to receive water from the drying container. During drying, produce received within the drying container is rotated which moves the water from the produce outwardly through the openings in the container sidewalls to the trough. At the conclusion of spin drying, the lower wall is moved downwardly away from its container enclosing position and the dried produce falls onto receiving conveyor belts for moving the dried produce to a packing station. At this time the drying container is subjected to short reciprocative movements which serves to shake loose any produce adhering to the inner surface of the container.

2 Claims, 5 Drawing Figures

FIG. 1.
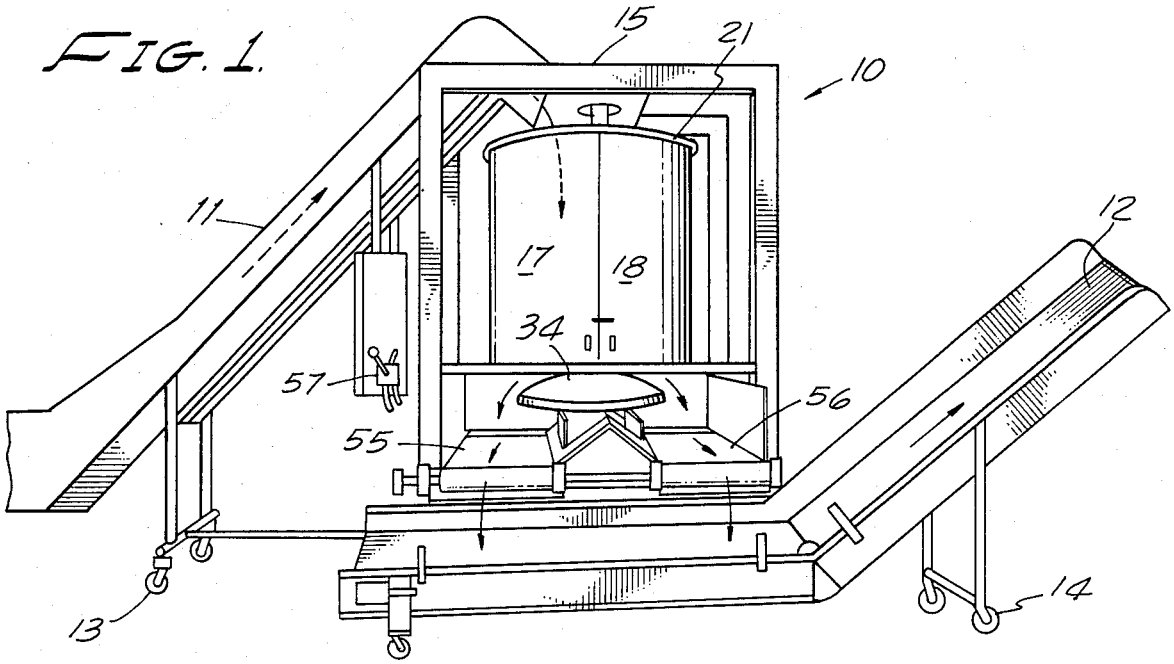
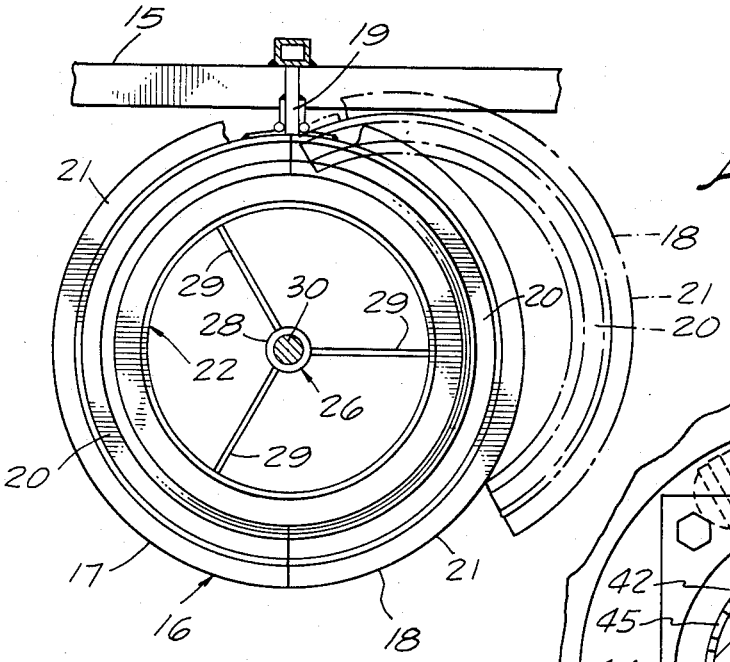
FIG. 4.
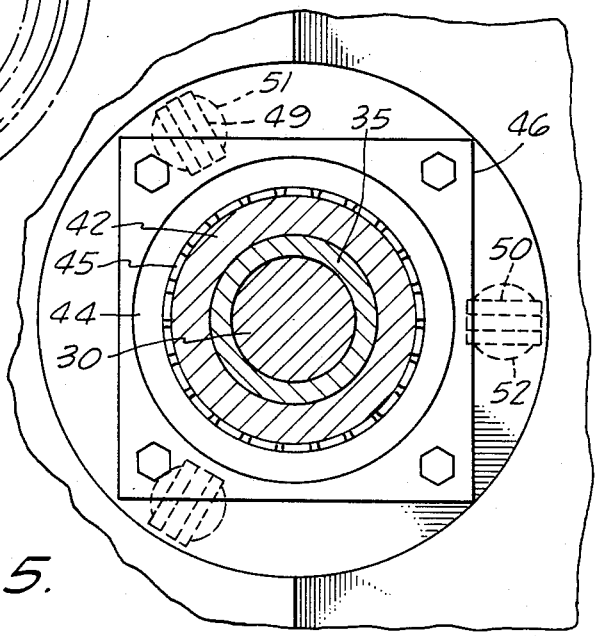
FIG. 5.

PRODUCE SPIN DRYER

The present invention relates generally to a spin dryer and, more particularly, to a flow-through spin dryer especially adaptable for drying produce and automatically discharging the dried produce onto a conveyor for transfer to a packing or storage station.

BACKGROUND

Produce, and particularly leafy vegetables such as lettuce, for example, not only must be washed in order to remove dirt and dust prior to packaging or shipment, but preferably must be dried to a certain extent in order to prevent rapid deterioration of fresh appearance as well as to retard the production of mold, either of which makes the product have less appeal to a purchaser. Also, produce is handled typically in packing stations in very large quantities, making it advisable that continuous drying in a flow-through manner be accomplished bringing the relatively freshly picked and washed produce into the apparatus and the dried product to a final packing station.

To date, known drying of large quantities of produce, such as leafy vegetables, has been by techniques requiring relatively cumbersome techniques for emptying the drying container after each batch.

SUMMARY OF THE INVENTION

Produce to be dried is conveyed into the open top of a generally cylindrical drying container with foraminous panels forming its sidewalls. The drying container has an open bottom which is received onto a vertically positionable, upwardly facing lower wall having a sloping surface. A pair of semi-cylindrical shielding walls encircle the drying basket and are spaced therefrom, the inner surface of which includes a trough arranged to receive water from the drying container. During the drying operational mode, produce received within the drying container is rotated with centrifugal force tending to move the water from the produce outwardly through the openings in the container sidewalls for receipt in the shielding walls trough to be conducted away. At the conclusion of the spin drying, the lower wall is moved downwardly away from its container enclosing position and the dried produce then falls downwardly onto receiving conveyor belts for moving the dried produce to a packing station. In addition, at this time the drying container is subjected to short rotative movements in consecutively opposite directions which serves to shake loose any produce adhering to the inner surface of the container.

DESCRIPTION OF THE DRAWING

FIG. 1 is an elevational view of the produce dryer described herein.

FIG. 4 is a top plan, sectional view taken along the line 4—4 of FIG. 2.

FIG. 5 is a top plan, sectional view taken along the line 5—5 of FIG. 3.

DESCRIPTION OF A PREFERRED EMBODIMENT

Figure 2:
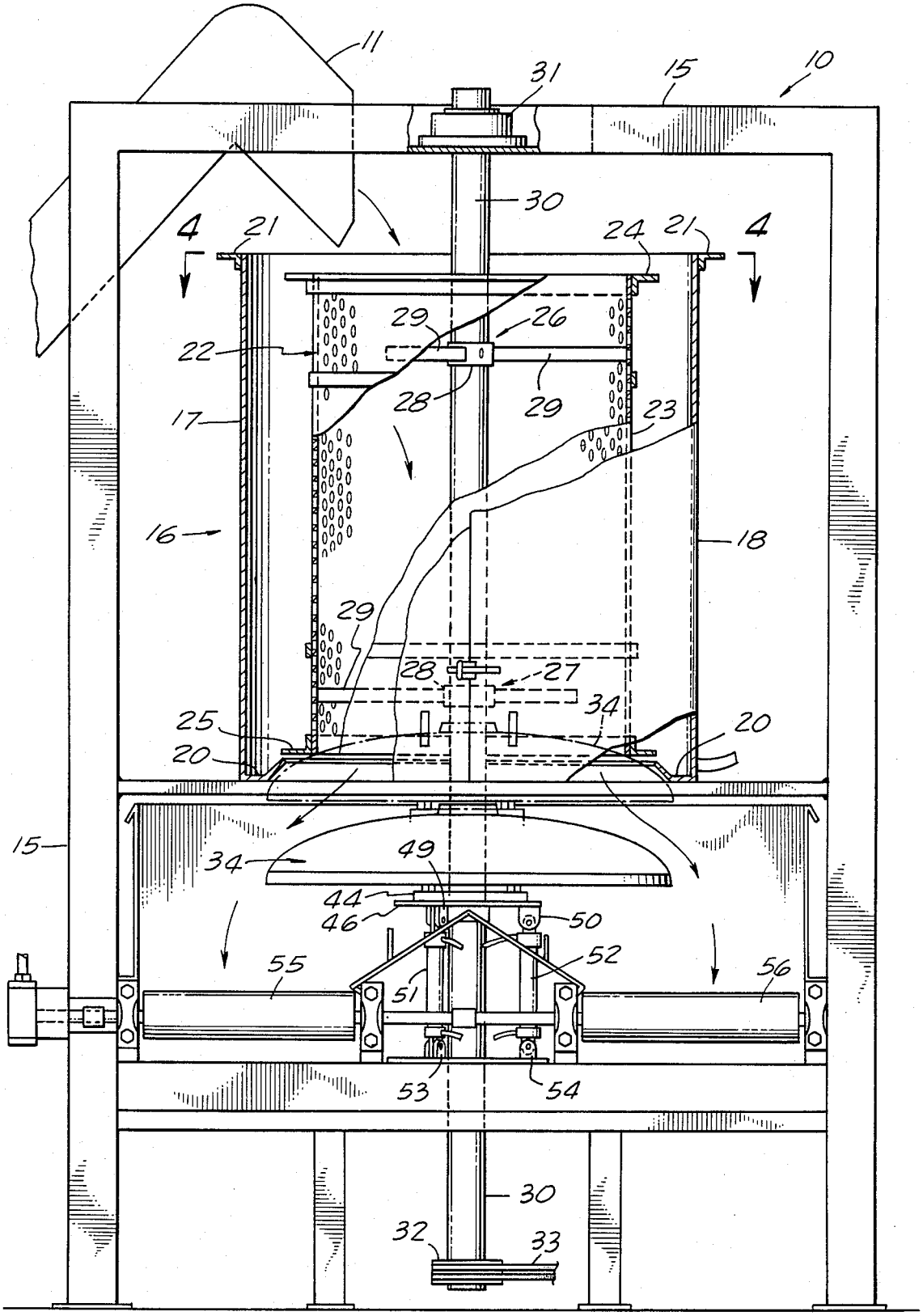
FIG. 2 is a sectional, elevational, partially fragmentary, view of the described dryer.

With reference now to the drawing, and particularly FIG. 1, the produce dryer to be described herein is referenced generally as at 10 and, among its major parts, includes an input conveyor 11 for bringing produce to be dried to the dryer, and an exit conveyor 12 for removing dried produce. The conveyors 11 and 12 are shown mounted on wheels 13 and 14, respectively, permitting ready positioning for accommodating auxiliary produce handling equipment.

Turning now to FIG. 2, the dryer is seen to be mounted within a ground based open frame 15 constructed of a plurality of angle iron beams unitarily welded together. A hollow, cylindrical shield 16 is formed of first and second imperforate, semicylindrical wall members 17 and 18 (FIG. 4) joined together by a single longitudinally extending hinge 19. The hinge is affixed to the frame 15 so as to orient the cylindrical shield longitudinal axis vertically. The lower edge of each semicylindrical wall member includes an inwardly directed flange 20 forming a circumferentially extending trough. The upper ends of the wall members have a reinforcing channel 21 affixed thereto. As shown in FIG. 4 the semicylindrical wall members 17, 18 can be closed on each other to form the cylindrical shield (solid line) or pivoted about the hinge 19 to an open position (dashed line depiction).

Located inwardly of the shield 16 is a drying container 22 consisting generally of a foraminous cylindrical wall 23 having outwardly extending channel flanges 24 and 25 secured to the upper and lower ends of the wall, respectively. A pair of spacer journaling means 26 and 27 are identical, each including a central sleeve 28 and three equilength arms 29 extending radially away from the collar at 120 degrees mutual angular spacing. The outer ends of the arms 29 are secured to the inner surface of the wall 23 by welding, for example, locating the two spacer and journaling means spaced apart along the drying container.

A drive shaft 30 is vertically oriented extending through and affixed to each of the sleeves 28 of the spacer and journaling means 26, 27, with the shaft uppermost extremity being journaled to the frame 15 as at 31. The lower end of the shaft 30 includes a pulley 32 interconnected with a source of rotative mechanical power via belts 33. That is, rotation of the shaft 30 turns each of the sleeves 28, arms 29 and drying container 22.

Figure 3:
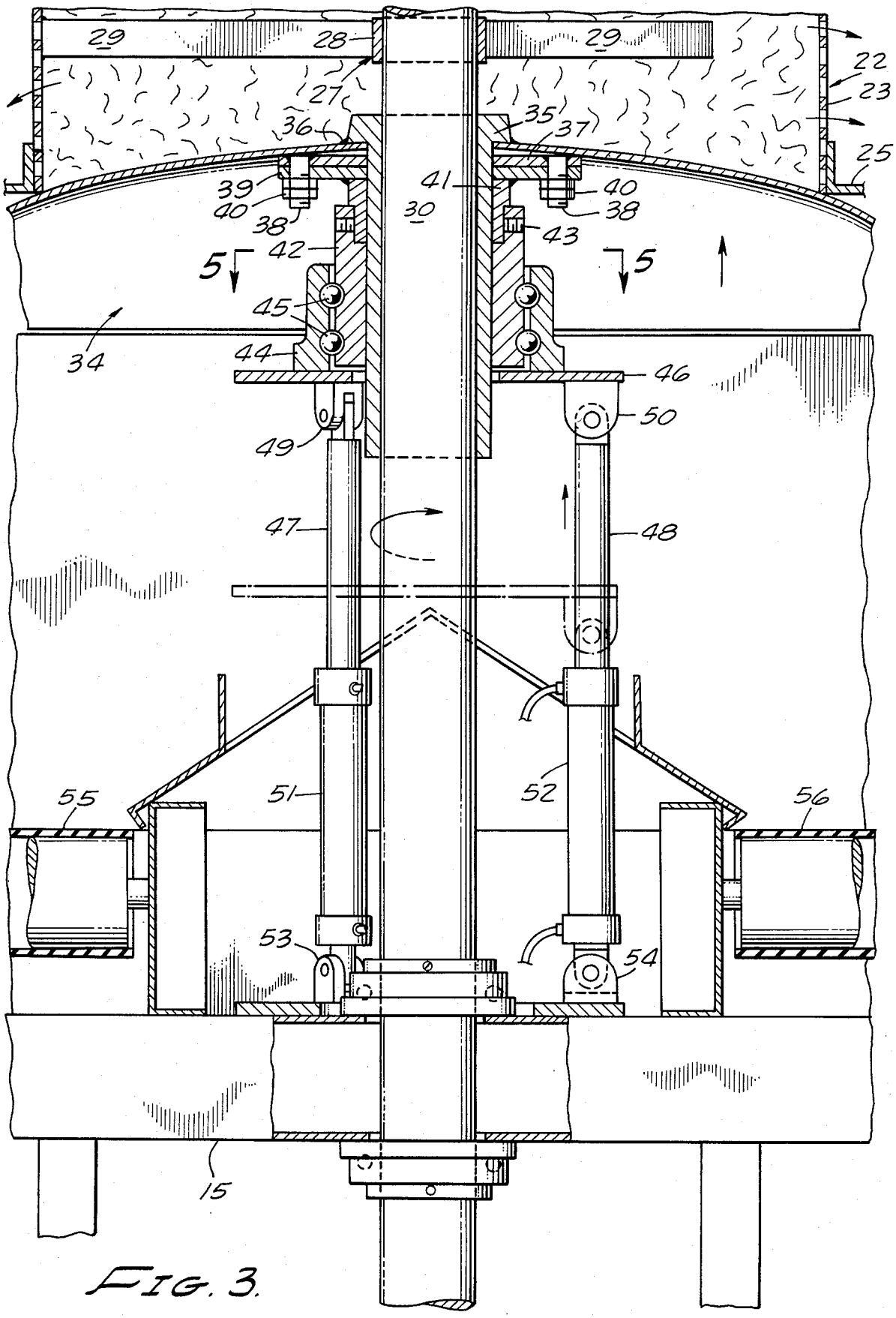
FIG. 3 is an enlarged, sectional, elevational view taken through the lower wall member of the drying container.

For the ensuing description of the vertically positionable lower wall member 34 and means for achieving selective positioning thereof, reference is made to both FIGS. 2 and 3. The wall member 34 is generally frustroconical in shape and has a central opening through which the drive shaft 30 extends. More particularly, an elongated sleeve 35 is slidingly received onto the shaft 30, passes through the central opening in the wall member 34 and has an enlarged head flange resting on the outer surface of the wall member. The sleeve 35 is preferably secured to the wall member 34 by one or more weldments, for example, as shown at 36. A first annular plate 37 with a central opening sufficient to permit sliding receipt over the sleeve 35 is welded to the inner surface of the wall member 34 and includes a plurality of studs 38 extending downwardly generally parallel to the shaft 30. A second annular plate 39, substantially identical to the first plate 37, includes openings for receiving the studs 38 therethrough for secured abutting relationship to the plate 37 by nuts 40. A relatively short cylindrical sleeve 41 is welded to the plate 39 and has a reduced diameter end portion which is received within a similarly shaped internal opening in a bearing sleeve 42, the two sleeves being locked together via set screws 43, for example. Bearing sleeve 42 is interrelated to an outer collar 44 via a set of ball bearings 45 whereby rotative freedom of movement of the movable bottom wall 34 with respect to the collar 44 is achieved.

The outer (i.e., lowemost) end of the collar 44 is affixed to a drive plate 46 an oversize central opening for accommodating the shaft 30 and elongated sleeve 35. Drive arms 47 and 48 each have one end pivotally connected to a yoke 49 and 50, respectively, secured to the undersurface of the plate 46. The other or lower ends of the drive arms 47, 48 are suitably connected to individual drive pistons (not shown) received within conventional hydraulic (or, optionally, pneumatic) drive means indicated generally as at 51 and 52. The lower ends of the hydraulic drive means 51, 52 are pivotally interconnected to yokes 53 and 54, respectively, mounted on frame 15. When drive means 51 and 52 are actuated to move the drive rods 47 and 48 to their uppermost or solid line depiction in FIG. 3, this brings the frustro-conical wall member 34 into closing contact with the lower end of the container 23 as shown in FIG. 3. When the hydraulic drive means are actuated to their other extreme (dash line depiction) the wall memmber 34 is moved away from its closing relationship to the container 23 and downwardly to a solid line depiction as shown in FIG. 2 thereby opening the bottom of container 23.

At opposite sides of the wall member 34 and directly underneath the outermost edges thereof, there are provided first and second belt conveyors 55 and 56 which are driven to move the material thereon toward and onto the exit conveyor 12 (FIG. 1).

In use, with the semi-cylindrical shields 17 and 18 closed and with the bottom wall member 34 in its uppermost position closing the bottom of the container 23, produce to be dried brought to the drying area by the conveyor 11 is dumped into the open top of the container until a suitable quantity of the produce is in the container. After loading of the container, switching means 57 (FIG. 1) are actuated to begin rotation of the shaft 30, the container basket and its lower wall 34 as a unit. This rotation is continued until the moisture has been driven by centrifugal force off the produce into the trough 20 formed along the inner lower edge of the shield 16. Rotation is then either stopped or reduced substantially, after which the hydraulic actuators 51 and 52 are impulsed to move the wall 34 downwardly and away from closed relation to the container 23. With the bottom of the container 23 now open a certain amount of the dried produce will fall out through the open space onto the belt conveyors 55 and 56 to be carried over to the conveyor 12 which, in turn, will take the dried produce out to, say, a packing station. As soon as the rotation is stopped, then the switch means 57 are set to an oscillating mode which causes the container 23 to oscillate back and forth serving to shake any produce adhering to the internal surface of the container 23 downwardly onto the upper surface of the wall member 34 and thus out into the conveyors 55 and 56.

In a practical construction of the described dryer especially adapted for the drying of leaf lettuce, the dryer container was preferably filled while the container was rotated at a relatively slow rate (e.g. 50 rpm) after which the drying was accomplished at a much higher speed. On completion of the high-speed drying cycle, the slow rotation was preferably resumed while the lower wall 34 was moved away from the container for initial emptying of the container. Finally, oscillatory drive for a short time (e.g., 30 seconds) completed the emptying of the container and the drying apparatus was then immediately available for another incoming batch of lettuce

I claim:

1. In a method of drying produce by spinning the produce in a foraminous walled container having a removable bottom wall at a first rotative speed for centrifugally removing moisture from the produce, the improvement comprising the steps of:

reducing the speed of rotation below said first rotative speed and below the speed at which the produce is centrifugally held to the foraminous container;

removing the container bottom wall to allow the dried produce to fall from the container while it is rotating at the reduced speed; and reciprocating the container about its axis of rotation while the container bottom wall is removed so as to shake loose any produce adhering to the foraminous container.

2. A produce dryer, comprising:

a hollow cylindrical open-ended foraminous member mounted for rotative movement about a generally vertical axis collinear with the cylindrical axis of the member;

first and second wall means hingedly related to one another to releasably enclose the cylindrical member while being spaced from said cylindrical member at all points said first and second wall means each including a generally semicylindrical wall member, the two wall members being joined at an edge by a hinge;

trough means affixed to an inner wall surface of said first and second wall means which join to form a closed path when said first and second wall means enclose the cylindrical member;

a bottom wall member being movable from a position spaced from said cylindrical member to a position closing the lower open end of said cylindrical member said bottom wall member including a generally frustro-conical upper surface that contacts the lower edge of the cylindrical member when closing the same, at which time the bottom wall member rotates with the cylindrical member; and means for selectively applying rotative power to said cylindrical member, said rotative power applying means being selectively actuatable to apply a reciprocating rotative motion of said cylindrical member for shaking loose any produce adhering inside said cylindrical member.

* * * * *